US010732553B2

(12) United States Patent
Kuroki et al.

(10) Patent No.: US 10,732,553 B2
(45) Date of Patent: Aug. 4, 2020

(54) IMAGE FORMING APPARATUS HAVING DEVELOPER ACCOMMODATING CONTAINER ROTATION DETECTION

(71) Applicant: CANON KABUSHIKI KAISHA, Tokyo (JP)

(72) Inventors: Tooru Kuroki, Tsukuba (JP); Hiromasa Katayama, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/254,996

(22) Filed: Jan. 23, 2019

(65) Prior Publication Data

US 2019/0235429 A1 Aug. 1, 2019

(30) Foreign Application Priority Data

Jan. 30, 2018 (JP) ..... 2018-013306
Jan. 10, 2019 (JP) ..... 2019-002471

(51) Int. Cl.
*G03G 15/00* (2006.01)
*G03G 15/08* (2006.01)
*G03G 21/16* (2006.01)

(52) U.S. Cl.
CPC ..... *G03G 15/502* (2013.01); *G03G 15/0872* (2013.01); *G03G 15/0877* (2013.01); *G03G 15/5016* (2013.01); *G03G 21/1633* (2013.01)

(58) Field of Classification Search
CPC ..... G03G 15/502; G03G 15/0877; G03G 15/5016; G03G 15/55; G03G 15/553; G03G 15/0879; G03G 15/0872
See application file for complete search history.

(56) References Cited

U.S. PATENT DOCUMENTS 9,671,748 B2 6/2017 Kobayashi et al.
2006/0159472 A1* 7/2006 Ushiroji ..... G03G 15/0872 399/27

(Continued)

FOREIGN PATENT DOCUMENTS

JP 2017-090708 A 5/2017

OTHER PUBLICATIONS

Hiromasa Katayama et al., U.S. Appl. No. 16/111,537, filed Aug. 24, 2018.

*Primary Examiner* — Sandra Brase
(74) *Attorney, Agent, or Firm* — Venable LLP

(57) ABSTRACT

An image forming apparatus includes a developing device configured to develop an electrostatic latent image formed on an image bearing member, a rotatable developer accommodating container dismountably mounted in the image forming apparatus and configured to accommodate a developer, and a mounting portion including a receiving portion for receiving the developer discharged from the container and configured to mount the container. A cover is configured to open and close the mounting portion, and a rotation detecting portion is configured to detect rotation of the container mounted at the mounting portion. In addition, a display portion displays information, and a controller controls the display portion so that information on the rotation of the container is displayed at the display portion in a case that when the cover is open, with the rotation detecting portion detecting a predetermined amount of the rotation of the container.

30 Claims, 5 Drawing Sheets

(56) References Cited

U.S. PATENT DOCUMENTS

2007/0269236 A1* 11/2007 Takuwa ..... G03G 15/0872
399/258
2017/0261924 A1 9/2017 Kobayashi et al.

* cited by examiner

IMAGE FORMING APPARATUS HAVING DEVELOPER ACCOMMODATING CONTAINER ROTATION DETECTION

FIELD OF THE INVENTION AND RELATED ART

The present invention relates to an image forming apparatus including a developer accommodating container for accommodating toner supplied to a developing device.

Conventionally, in the image forming apparatus, when an amount of a developer in the developing device is decreased by image formation, the developer is supplied from the developer accommodating container to the developing device through a developer feeding path (Japanese Laid-Open Patent Application 2017-90708). When an amount of the developer in the developing device is a predetermined amount or less, the developer in the developer feeding path is supplied to the developing device by rotating a screw in the developer feeding path. Thereafter, the developer accommodating container is rotated by a motor, so that the developer is supplied from the developer accommodating container to the developing device. By controlling rotation of the developer accommodating container driven by the motor, the developer in a stable amount can be supplied from the developer accommodating container to the developing device.

However, when a user dismounts the developer accommodating container or when the user unnecessarily rotates the mounted developer accommodating container, supply of the developer in a state in which there is no need to supply the developer is caused.

SUMMARY OF THE INVENTION

A principal object of the present invention is to provide an image forming apparatus capable of reducing a degree of unnecessary supply of a developer due to unnecessary rotation of a developer accommodating container by a user.

According to an aspect of the present invention, there is provided an image forming apparatus comprising: a developing device configured to develop an electrostatic latent image formed on an image bearing member; a rotatable developer accommodating container dismountably mounted in the image forming apparatus and configured to accommodate a developer; a mounting portion including a receiving portion for receiving the developer discharged from the developer accommodating container and configured to mount the developer accommodating container; a cover configured to open and close the mounting portion; a rotation detecting portion configured to detect rotation of the developer accommodating container mounted at the mounting portion; a display portion configured to display information; and a controller configured to control the display portion so that information on the rotation of the developer accommodating container is displayed at the display portion in a case that when the cover is open, the rotation detecting portion detects a predetermined amount of the rotation of the developer accommodating container.

Further features of the present invention will become apparent from the following description of exemplary embodiments with reference to the attached drawings.

DESCRIPTION OF EMBODIMENTS

With reference to the drawings, embodiments for carrying out the present invention will be described. Incidentally, the following embodiments should not be construed as limiting the present invention thereto. Further, all combinations of structures described in the embodiments also should not be construed restrictively as being essential constituent elements of the present invention.

<Image Forming Apparatus>

Figure 1:
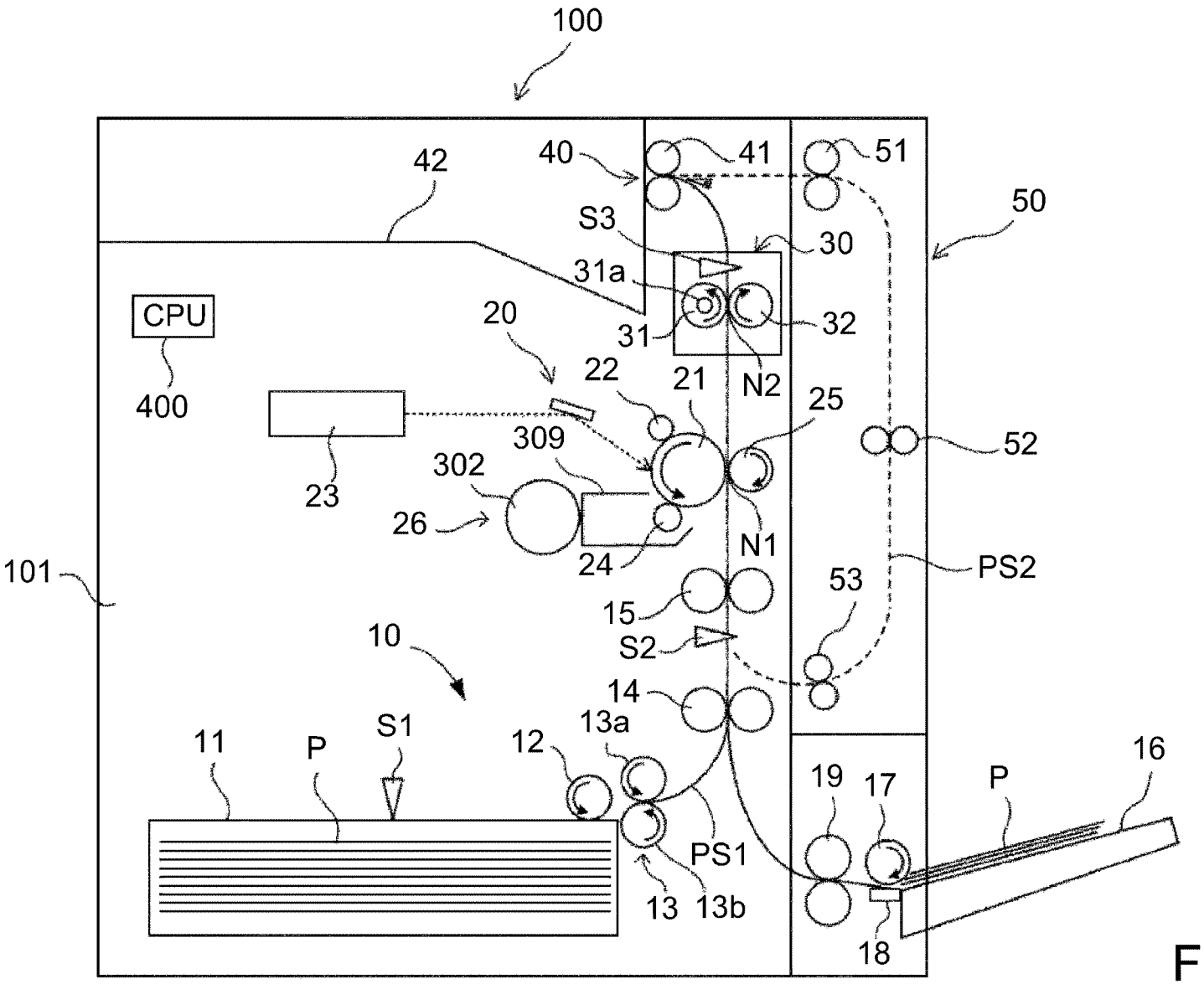
FIG. 1 is a sectional view of an image forming apparatus.

FIG. 1 is a sectional view of an image forming apparatus 100. In this embodiment, the image forming apparatus 100 will be described by citing a printing apparatus (printer) for forming an image on a sheet by using an electrophotographic process, as an example. However, the image forming apparatus 100 is not limited to the printing apparatus but may also be, for example, a copying machine, a multi-function peripheral (MFP) or a facsimile machine. Incidentally, the multi-function peripheral is an image forming apparatus having at least two functions of a plurality of functions including a printing (print) function, a scanning function, a copying function and a facsimile function. The sheet is a recording medium on which the image is to be formed using the electrophotographic process, and is paper, an OHP sheet, a cloth or the like, for example. The sheet may also be referred to as recording paper, a recording material, the recording medium, a form, a transfer(-receiving) material, transfer(-receiving) paper or the like.

The image forming apparatus 100 may also be a color image forming apparatus for forming a color image with toners, as a developer, of a plurality of colors, but in this embodiment, the image forming apparatus 100 for forming a monochromatic image with monochromatic (single color) toner will be described. The image forming apparatus 100 includes a sheet feeding portion 10, an image forming portion 20, a fixing portion 30 and a sheet discharging portion 40 provided in a named order from a lower side (an upstream side with respect to a sheet feeding direction) toward an upper side (a downstream side with respect to the sheet feeding direction) in FIG. 1. Further, on a right side of the image forming portion 20 and the fixing portion 30, a sheet re-feeding portion 50 is provided. A CPU 400 as a controller controls operations of respective portions of the image forming apparatus 100 in order to form the image on the sheet.

The sheet feeding portion 10 feeds a sheet P, stacked in a cassette 11 or on a tray 16, toward the image forming portion 20. A sensor S1 detects the sheet P stacked in the cassette 11. The CPU 400 discriminates, on the basis of a detection result of the sensor S1, whether or not the sheet P is accommodated in the cassette 11. The sheet P accommodated in the cassette 11 is fed to a separation roller pair 13 by rotation of a pick-up roller 12. In the case where multi-feeding (double feeding) of the sheets P is caused, two or more sheets are separated one by one by the separation roller pair 13 consisting of a normal rotation roller 13*a* and a reverse rotation roller 13*b*. The sheet P separated by the separation roller pair 13 is fed to a feeding path PS1 indicated by a solid line. The sheet P fed to the feeding path PS1 is further fed by a feeding roller pair 14. Then, oblique movement of the sheet P is corrected by causing a leading end of the sheet P to follow a nip of a registration roller pair 15 which stops rotation thereof.

In the case where the sheet P is fed from the tray 16, the sheets P are separated one by one by a feeding roller 17 and a separation pad 18. The separated sheet P is fed toward the feeding roller pair 14 by a conveying roller pair 19. Oblique movement of the sheet P is corrected by the registration roller pair 15. The sheet P of which oblique movement is corrected is fed toward the image forming portion 20 by the registration roller pair 15 which starts rotation thereof at predetermined timing. A sensor S2 detects timing when the leading end of the sheet reaches the nip of the registration roller pair 15.

In the image forming portion 20, a photosensitive drum 21 as a photosensitive member is rotated in a direction indicated by an arrow. A surface of the photosensitive drum 21 is electrically charged by a charging roller 22. A laser scanner 23 emits laser light, toward the charged surface of the photosensitive drum 21, modulated in accordance with image data sent from an external portion. At a portion of the surface of the photosensitive drum 21 irradiated with the laser light, electric charges given by the charging roller 22 are removed, whereby an electrostatic latent image is formed on the surface of the photosensitive drum 21 in accordance with the image data. A developing roller 24 of a developing device 26 develops the electrostatic latent image with a developer (hereinafter referred to as toner) and visualizes the electrostatic latent image into a toner image. The developing device 26 includes a developer accommodating container 302 for accommodating the toner (hereinafter, this container 302 is referred to as a toner bottle) and a developing device (portion) 309 as a developing container in which the developing roller 24 is provided. The toner bottle 302 supplies the toner to the developing device 309 as needed. The developing device 26 will be described later.

The photosensitive drum 21 forms a transfer nip N1 in contact with a transfer roller 25. The toner image on the photosensitive drum 21 is fed toward the transfer nip N1 by rotation of the photosensitive drum 21. In synchronism with this timing, the sheet P is fed from the registration roller pair 15 toward the transfer nip N1. The toner image is transferred from the photosensitive drum 21 onto the sheet P by the transfer roller 25 while the sheet P is nipped and fed through the transfer nip N1 by the photosensitive drum 21 and the transfer roller 25. The sheet P on which the toner image is transferred is fed toward the fixing portion 30

The fixing portion 30 includes a fixing roller 31 and a pressing roller 32. The fixing roller 31 is an aluminum roller in which a halogen lamp 31*a* as a heat source is provided. The halogen lamp 31*a* heats the fixing roller 31 to a predetermined fixing temperature. The pressing roller 32 contacts the fixing roller 31 with a predetermined pressure and forms a fixing nip N2 therebetween. The sheet P on which the toner image is transferred is heated and pressed by being nipped and fed through the fixing nip N2 by the fixing roller 31 and the pressing roller 32, so that the toner image is fixed on the sheet P and thus an image is formed on the sheet P. A sensor S3 detects that a trailing end of the sheet P has passed through the fixing nip N2. Incidentally, a heating type of the fixing portion 30 may also be an on-demand fixing type in which a ceramic heater as the heat source and an endless film are used, in place of a heating roller type in which the sheet P is heated by the fixing roller 31. In the on-demand fixing type, the pressing roller 32 presses the endless film toward the ceramic heater and forms the fixing nip N2 between itself and the endless film. The sheet P on which the toner image is transferred is heated and pressed by being nipped and fed through the fixing nip N2 by the endless film and the pressing roller 32, so that the toner image is fixed on the sheet P and thus an image is formed on the sheet P.

The sheet P on which the image is formed is fed to the sheet discharging portion 40, where the sheet P is discharged onto a tray 42 by a discharging roller pair 41. In the case where images are formed on both sides (surfaces) of the sheet P, the discharging roller pair 41 is once stopped after the trailing end of the sheet P on which the image is formed at a first surface passes through the sensor S3 and before the trailing end of the sheet P passes through the discharging roller pair 41. Then, the discharging roller pair 41 is reversely rotated, whereby the sheet P is fed toward the sheet re-feeding portion 50. The sheet P fed to the sheet re-feeding portion 50 is fed along a feeding path PS2, indicated by a broken line, by a re-feeding roller pair 51 and 52 and then is fed toward the registration roller pair 15 by a re-feeding roller pair 53. The sheet P is subjected to correction of oblique movement thereof by the registration roller pair 15, and thereafter is fed to the transfer nip N1, so that the toner image is transferred onto a second surface of the sheet P. Then, similarly as in image formation on the first surface of the sheet P, the toner image is fixed on the second surface of the sheet P by feeding the sheet P through the fixing nip N2. The sheet P on which the images are formed at the first and second surfaces thereof is discharged onto the tray 42 by the discharging roller pair 41.

<Developing Device>

Figure 2:
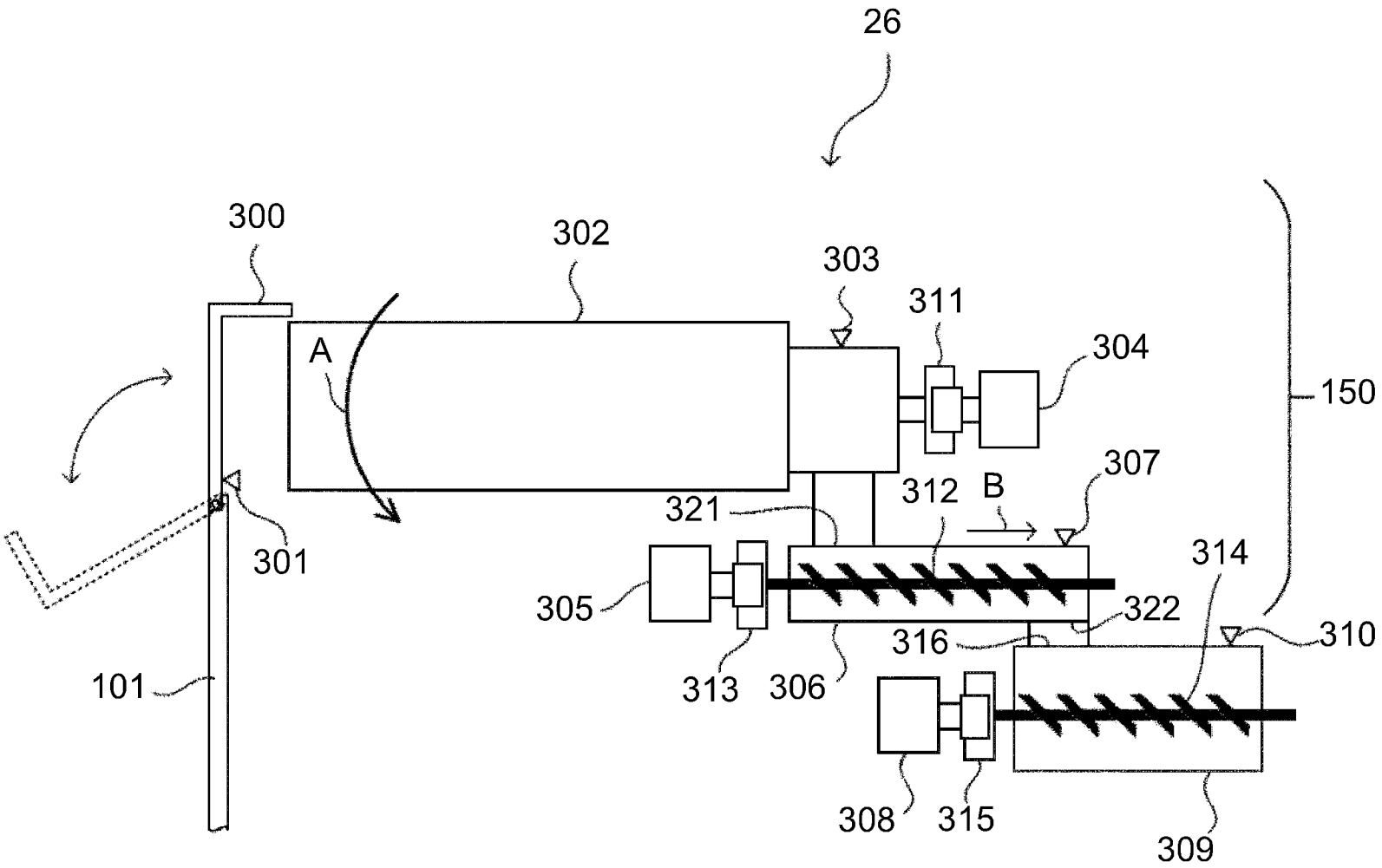
FIG. 2 is a schematic view showing a structure of a developing device.

FIG. 2 is a schematic view showing a structure of the developing device 26. The toner bottle 302 is constituted so as to be mountable in and dismountable from a main assembly 101 of the image forming apparatus 100. The toner bottle 302 is dismountably (removably) mounted in the main assembly 101 of the image forming apparatus 100. A toner cover 300 is provided on the main assembly 101 of the image forming apparatus 100 so as to be openable and closable relative to the main assembly 101. The toner cover 300 is opened when the toner bottle 302 is mounted in the main assembly 101. A user has access to the toner bottle 302 by opening the toner cover 300. In the case where the toner in the toner bottle 302 is used up by the image formation, the user opens the toner cover 300 and then exchanges the toner bottle 302 with a new one. As a result, the image formation is successively carried out. A toner cover sensor (cover developer) 301 detects opening and closing of the toner cover 301. A toner supplying portion 150 includes the toner bottle 302, a bottle motor (first driving means) 304 and a toner feeding path 306. The toner feeding path 306 is provided between the toner bottle 302 and the developing device 309 and is provided with an inlet 321 through which the toner discharged from the toner bottle 302 is received and an outlet 322 through which the toner is discharged to the developing device 309.

The toner bottle 302 is connected with the bottle motor 304 via a driving gear train 311. By rotation of the bottle motor 304, the toner bottle 302 is rotated in an arrow A direction. The toner bottle 302 is rotated by the bottle motor 304, whereby the toner is detection sequenced from an inside of the toner bottle 302. The toner discharged from the toner bottle 302 flows into the toner feeding path 306. The toner supplying portion 150 is provided with a home position sensor (hereinafter referred to as an HP sensor) 303. The HP sensor 303 is a rotation detector for detecting a reference position (home position) of the rotation of the toner bottle 302. A detection result of the HP sensor 303 is also used for detecting a rotational speed of the toner bottle 302. Together with the HP sensor 303, a rotation detector for detecting the rotational speed of the toner bottle 302 on the basis of a rotation detection signal outputted from the bottle motor 304 may also be provided.

In the toner feeding path 306, a screw 312 as a toner feeding means for feeding the toner, received through the inlet 321, toward the outlet 322 is provided. The screw 312 is connected with a feeding path motor 305 via a driving gear train 313. A rotational driving force is transmitted from the feeding path motor 305 to the screw 312 via the driving gar train 313. The screw 312 is driven and rotated by the feeding path motor 305 and feeds the toner, caused to flow into the toner feeding path 306 from the toner bottle 302, in an arrow B direction. The toner fed through the toner feeding path 306 is discharged to the developing device 309 at an end portion of the toner feeding path 306. The toner supplying portion 150 is provided with a feeding path toner sensor 307. The feeding path toner sensor 307 detects the toner in the toner feeding path 306. In the case where the feeding path toner sensor 307 does not detect the toner in the toner feeding path 306 even when the toner bottle 302 is rotated, the CPU 400 discriminates that the toner bottle 302 is empty.

The developing device 309 is provided with a screw 314. The screw 314 is connected with a developing motor 308 via a driving gear train 315. A rotational driving force is transmitted from the developing motor 308 to the screw 314 via the driving gear train 315. The toner in the developing device 309 is stirred by the screw 314 rotated by the developing motor 308 and is stably supplied to the developing roller 24. The developing device 309 is provided with a developing device toner sensor 310 for detecting an amount of the toner in the developing device 309.

<Control System>

Figure 3:
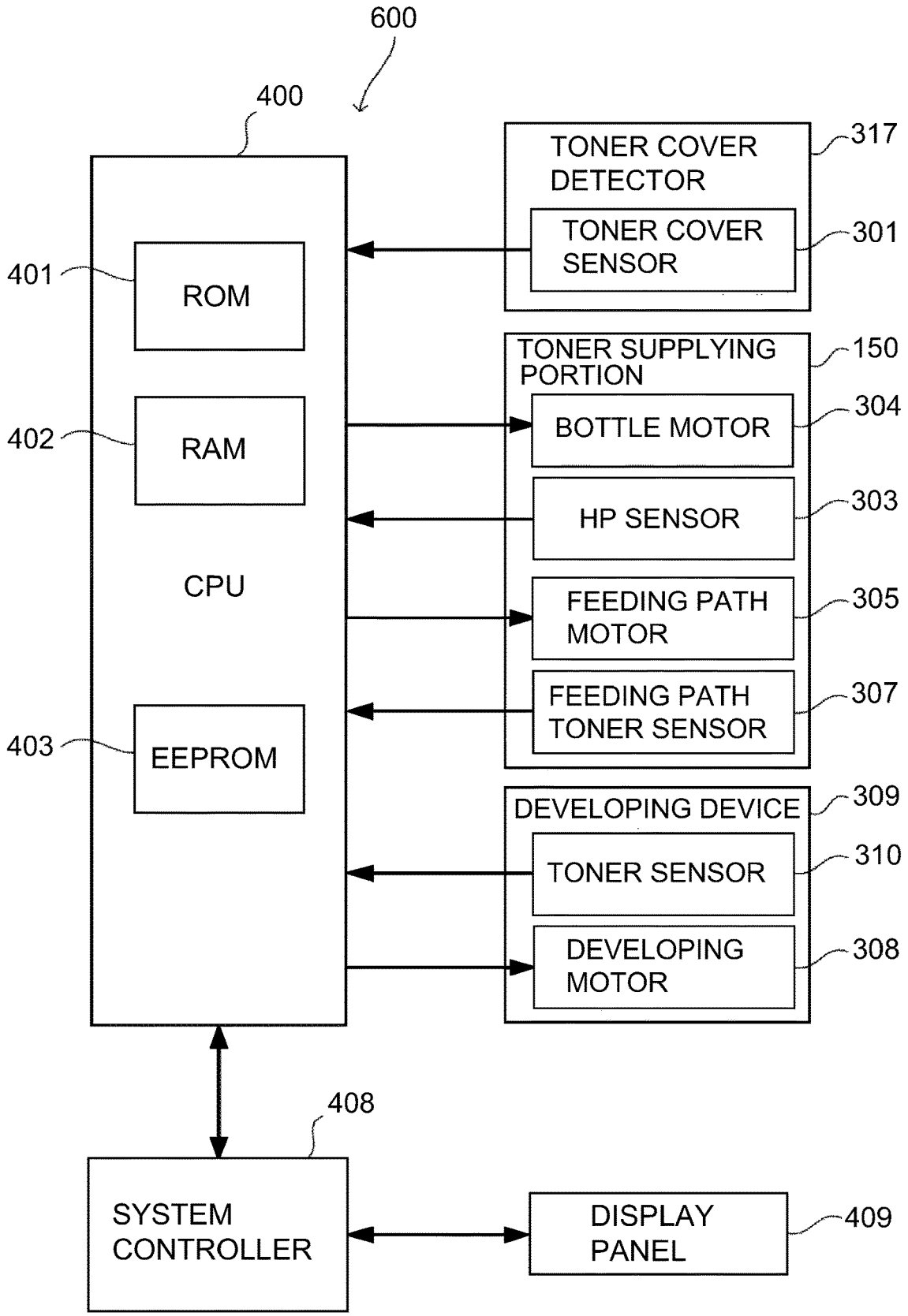
FIG. 3 is a block diagram showing a constitution of a control system for controlling the developing device.

FIG. 3 is a block diagram showing a constitution of a control system 600 for controlling the developing device 26. The control system 600 includes the CPU 400, a system controller 408 and a display panel (operating portion) 409. The CPU 400 as the control means includes a ROM 401, a RAM 402 and an EEPROM 403. In the ROM 401, a control program for controlling an entirety of the image forming apparatus 100 is stored. The RAM 402 is a volatile storing device not only used as an operational area of the CPU 400 but also used for temporarily storing various data such as the image data. The EEPROM 403 is a non-volatile storing device and stores various data such as a remaining toner amount in the developing device 309. The CPU 400 reads the control program stored in the ROM 401 and reads the control program into the RAM 402, and then executes the control program, so that the CPU 400 controls an entirety of the image forming apparatus 100. The CPU 400 is electrically connected with a toner cover opening and closing detecting portion 317, the toner supplying portion 150 and the developing device 309 of the developing device 26.

The CPU 400 controls an operation of the toner supplying portion 150 by controlling operations of the bottle motor 304 and the feeding path motor 305. Into the CPU 400, a signal outputted from the feeding path toner sensor 307 of the toner supplying portion 150 and a signal outputted from the developing device toner sensor 310 of the developing device 309 are inputted. The CPU 400 controls the supply of the toner from the toner supplying portion 150 toward the developing device 309, on the basis of the signals outputted from the feeding path toner sensor 307 and the developing device toner sensor 310.

In the case where an output signal from the feeding path toner sensor 307 indicates that there is no toner in the toner feeding path 306, the CPU 400 drives the bottle motor 304, so that the toner is supplied from the toner bottle 302 into the toner feeding path 306. The CPU 400 controls the bottle motor 304 every time when toner in the toner feeding path 306 is empty as detected using the feeding path toner sensor 307, so that the toner bottle 302 is rotated. Further, on the basis of an output signal from the developing device toner sensor 310, the CPU 400 discriminates whether or not the amount of the toner in the developing device 309 is smaller than a predetermined amount. In the case where the CPU 400 discriminated that the toner amount in the developing device 309 is smaller than the predetermined amount, the CPU 400 drives the feeding path motor 305 and thus the screw 312 is rotated, so that the toner is supplied from the toner feeding path 306 toward the developing device 309. The CPU 400 controls the feeding path motor 305 every time when the toner amount in the developing device 309 detected using the developing device toner sensor 310 is smaller than the predetermined amount, so that the screw 312 is rotated.

The feeding path toner sensor 307 outputs an ON-state signal when it detects the toner in the toner feeding path 306 and outputs an OFF-state signal when it does not detect the toner in the toner feeding path 306. The CPU 400 monitors the output signal from the feeding path toner sensor 307 at a predetermined time interval and discriminates the presence or absence of the toner in the toner feeding path 306 on the basis of the output signal from the feeding path toner sensor 307. For example, in the case where the output signal from the feeding path toner sensor 307 is the OFF-state signal continuously for predetermined times, the CPU discriminates that there is no toner in the toner feeding path 306.

The developing device toner sensor 310 outputs an ON-state signal in the case where an amount of the toner in the developing device 309 is larger than a predetermined amount and outputs an OFF-state signal in the case where the toner amount in the developing device 309 is smaller than the predetermined amount. The CPU 400 monitors the output signal from the developing device toner sensor 310 at a predetermined time interval and discriminates the presence or absence of the toner in the developing device 309 on the basis of the output signal from the developing device toner sensor 310. For example, in the case where the output signal from the developing device toner sensor 310 is the OFF-state signal continuously for predetermined times, the CPU may also discriminate that the toner amount in the developing device 309 is smaller than the predetermined amount.

In a case other than the case where the CPU 400 controls the bottle motor 304 and thus rotates the toner bottle 302 with the result that the toner is supplied to the toner feeding path 306 (i.e., toner feeding control), the toner is unintentionally supplied from the toner bottle 302 toward the toner feeding path 306 by an external force in some instances. In such a case, there is a possibility that the toner feeding path 306 is clogged with the toner due to excessive supply of the toner and that the toner overflows the toner feeding path 306 and thus an inside of the image forming apparatus 100 is contaminated with the toner. Therefore, the CPU 400 detects that the toner bottle 302 is rotated by a force other than a driving force of the bottle motor 304, and prevents clogging of the toner feeding path 306 with the toner and contamination of the inside of the image forming apparatus 100 with the toner.

<Toner Bottle Hand Rotation Detection Control>

Figure 4:
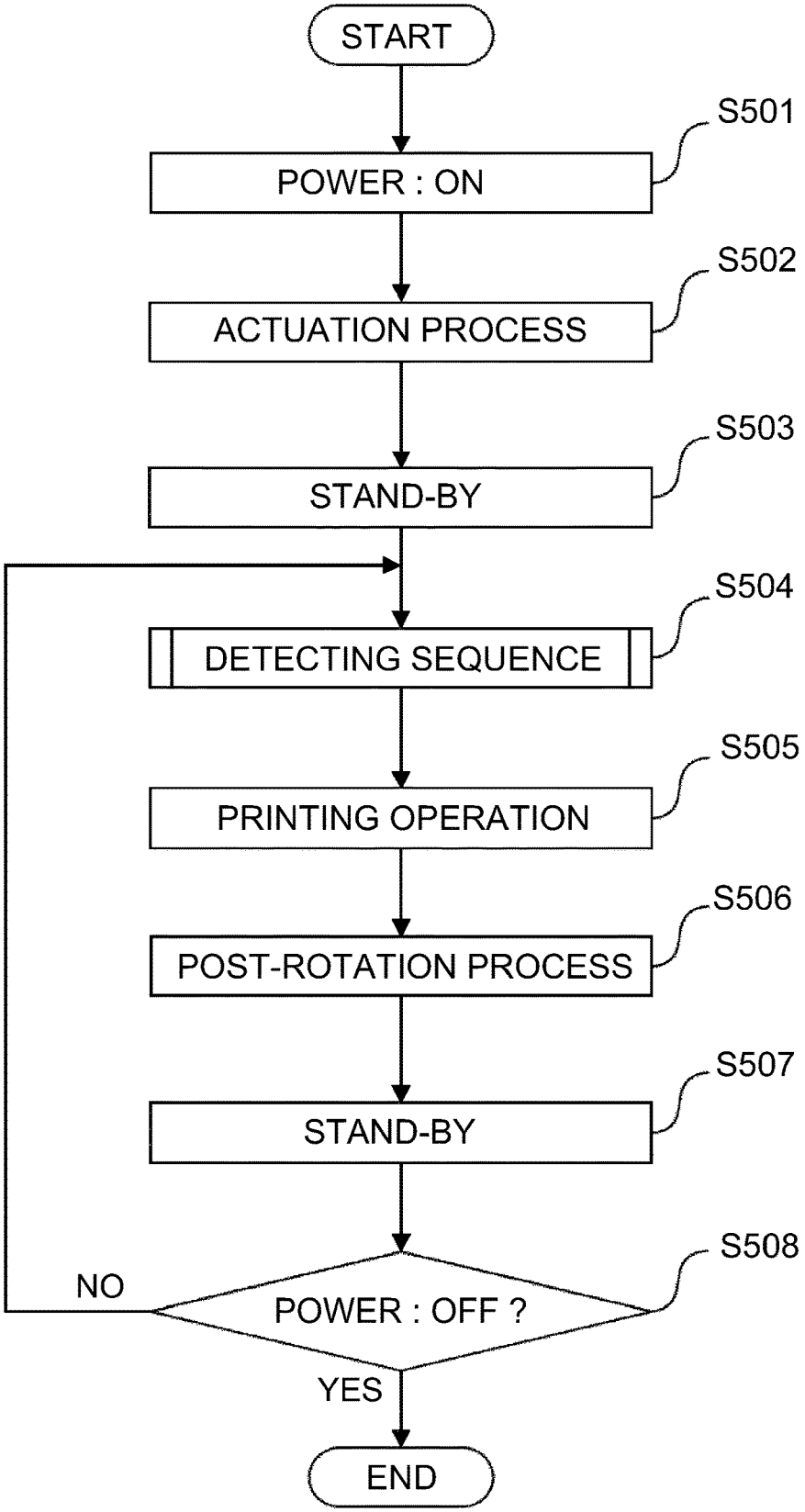
FIG. 4 is a flowchart showing a main assembly control operation of the image forming apparatus.

In the following, toner bottle hand rotation detection control for detecting rotation of the toner bottle 302 by hand(s) of a user will be described. First, with reference to FIG. 4, a main assembly control operation for controlling the image forming apparatus 100 will be described. FIG. 4 is a flowchart showing a process in the main assembly control operation of the image forming apparatus 100. The CPU 400 reads a program, stored in the ROM 401, in the RAM 402 and then executes the main assembly control operation.

When a main switch of the image forming apparatus 100 is turned on (S501), the CPU 400 executes an actuation process such as register setting and jam (paper jam) detection, or the like process (S502). When the actuation process is completed, the CPU 400 causes the image forming apparatus 100 to go to a stand-by mode (state) (S503). In the stand-by mode, the image forming apparatus 100 is in an image formable state in which the image forming apparatus 100 awaits a print job start instruction so that a printing operation can be immediately started upon receipt of the print job start instruction from the display panel 409 or an external device. The CPU 400 causes the image forming apparatus 100 to go to a hand rotation detection sequence from the stand-by mode (S504). The hand rotation detection sequence will be described later. When the CPU 400 receives the print job start instruction, the CPU 400 causes the image forming apparatus 100 to start the printing operation (S505). When the printing operation is ended, the CPU 400 causes the image forming apparatus 100 to perform a post-rotation process such as cleaning (S506). Then, the CPU 400 causes the image forming apparatus 100 to go to the stand-by mode again (S507). The CPU 400 discriminates whether or not the main switch is turned off (S508). In the case where the main switch is not turned off (NO of S508), the CPU 400 causes the image forming apparatus 100 to go to the hand rotation detection sequence from the stand-by mode (S504). In the case where the main switch is turned off (YES of S508), the CPU 400 causes the image forming apparatus 100 to end the main assembly control operation.

Figure 5:
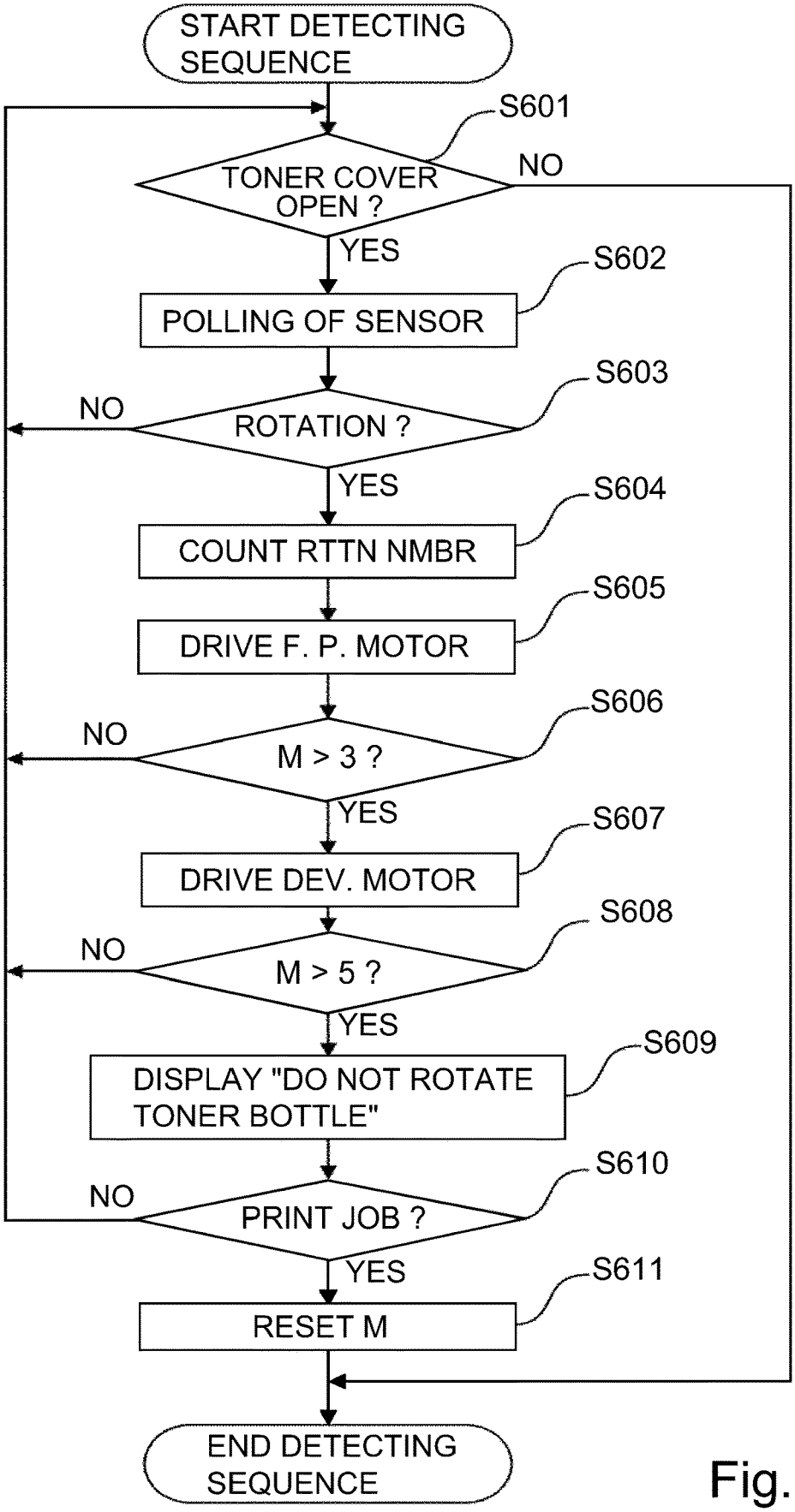
FIG. 5 is a flowchart showing a hand rotation detection sequence.

Next, with reference to FIG. 5, the hand rotation detection sequence in S504 of FIG. 4 will be described. FIG. 5 is a flowchart showing the hand rotation detection sequence. During the stand-by mode, the CPU 400 causes the image forming apparatus 100 to perform the hand rotation detection sequence for detecting the rotation of the toner bottle 302 by the hand(s) of the user.

When the hand rotation detection sequence is started, the CPU 400 discriminates whether or not the toner cover 300 is opened, on the basis of a detection result of the toner cover sensor 301 (S601). In the case where the toner cover 300 is not opened (NO of S601), the CPU 400 causes the image forming apparatus 100 to end the hand rotation detection sequence. In the case where the toner cover 300 is opened (YES of S601), the CPU 400 starts polling of the HP sensor 303 in order to detect the rotation of the toner bottle 302 (S602). The CPU 400 discriminates whether or not the toner bottle 302 is rotated, on the basis of a detection result of the HP sensor 303 (S603). In the case where the toner bottle 302 is not rotated (NO of S603), the CPU 400 returns the process (sequence) to S601. In the case where the toner bottle 302 is rotated (YES of S603), on the basis of the detection result of the HP sensor 303, the CPU 400 counts the number of rotations (turns) of the toner bottle 302 (S604). The CPU 400 has a function as a counting means for counting the number of rotations of the toner bottle 302 in a period in which the toner cover 300 is open. When the toner bottle 302 is rotated, the toner in the toner bottle 302 is discharged from the toner bottle 302 into the toner feeding path 306. The CPU 400 drives the feeding path motor 305, so that the screw 312 is rotated (S605). By rotation of the screw 312, the toner in the toner feeding path 306 is discharged into the developing device 309. As a result, the clogging of the toner feeding path 306 with the toner is prevented.

The CPU 400 discriminates whether or not a count value M of the number of rotations of the toner bottle 302 is larger than a first predetermined value (threshold) (S606). In this embodiment, the first predetermined value is set at 3. However, the first predetermined value is not limited to 3 but may also be another numerical value. The count value M of the number of rotations of the toner bottle 302 represents the number of times of rotation of the toner bottle 302 by the hand(s) of the user when the user opens the toner cover 300 in the stand-by mode. In the case where the count value M is 3 or less (NO of S606), the CPU 400 returns the process to S601. In the case where the count value M is larger than 3 (YES of S606), the CPU 400 drives the developing motor 308, so that the screw 314 is rotated (S607). By rotation of the screw (stirring means) 314, the toner in the developing device 309 is stirred, so that clogging of an inlet 316 of the developing device 309 with the toner discharged from the toner feeding path 306 to the developing device 309 is prevented.

The CPU 400 detects whether or not the toner bottle 302 is further rotated by the hand(s) of the user. Specifically, the CPU 400 discriminates whether or not the count value M of the number of rotations of the toner bottle 302 is larger than a second predetermined value (threshold) (S608). In this embodiment, the first predetermined value is set at 5. However, the first predetermined value is not limited to 5 but may also be another numerical value. The second predetermined value is larger than the first predetermined value. In the case where the count value M is 5 or less (NO of S608), the CPU 400 returns the process to S601. In the case where the count value M is larger than 5 (YES of S608), the CPU 400 causes the display panel 409 as a display portion to display a message thereon such that "DO NOT ROTATE THE TONER BOTTLE" (S609). By this message, the user is prompted to refrain from rotating the toner bottle 302 by the hand(s) of the user.

The CPU 400 discriminates whether or not the print job (start instruction) is received (S610). In the case where the print job is not received (NO of S610), the CPU 400 returns the process to S601. In the case where the print job is received (YES of S610), the CPU 400 resets the count value M to zero (S611). This is because when the printing operation is started, the toner in the developing device 309 is consumed and the toner amount in the developing device 309 is returned to a proper amount. Then, the CPU 400 ends the hand rotation detection sequence.

In the case where the toner bottle 302 is rotated by an external force such as the hand(s) of the user when the image formation is not carried out, the toner feeding path 306 is clogged with the toner discharged from the toner bottle 302 or the inside of the image forming apparatus 100 is contaminated with the leaked toner. Therefore, according to this embodiment, when the toner cover 300 is opened during the stand-by mode in which the image formation is not carried out, whether or not the toner bottle 302 is rotated is detected. When the rotation of the toner bottle 302 is detected, the screw 312 is rotated by driving the feeding path motor 305, so that the toner in the toner feeding path 306 is discharged to the developing device 309. As a result, the clogging of the toner feeding path 306 with the toner is prevented. When further rotation of the toner bottle 302 is detected, the screw 314 is rotated by driving the developing motor 308, so that the toner in the developing device 309 is stirred. As a result, clogging of the inlet 316 of the developing device 309 with the toner is prevented. When further rotation of the toner bottle 302 is detected, a message for prompting the user to refrain from rotating the toner bottle 302 is displayed on the display panel 409.

Incidentally, in this embodiment, as a user operation detecting means, an example in which the operation by the user is detected in the case where the toner cover sensor 301 detects that the toner cover 300 opens and the HP sensor 303 detects the rotation of the toner bottle 302 was described, but the present invention is not limited thereto. For example, the operation by the user may also be detected by detection of the rotation of the toner bottle 302 by the HP sensor 303 when there is no rotation signal to the bottle motor 304. Further, from the toner bottle 302, some toner can be discharged even by an insertion and extraction operation of the toner bottle 302. Accordingly, in the case where the insertion and extraction operation of the toner bottle 302 by the user is detected by the HP sensor 303 and repetition of this detection in a short time such as about 10 seconds is detected, the insertion and extraction operation may also be detected as an operation in which the toner is discharged in an amount more than an allowable amount. Further, as a notifying means, the display panel was described, but the notifying means may also be an error sound. Further, even by only control or notification of the control of a downstream unit, an effect can be obtained.

According to the present invention, the image forming apparatus 100 is capable of reducing a degree of unnecessary supply of the developer due to unnecessary rotation of the developer accommodating container by the user.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2018-013306 filed on Jan. 30, 2018 and 2019-002471 filed on Jan. 10, 2019, which are hereby incorporated by reference herein in their entirety.

What is claimed is:

1. An image forming apparatus comprising:

a developing device configured to develop an electrostatic latent image formed on an image bearing member;

a rotatable developer accommodating container dismountably mounted in said image forming apparatus and configured to accommodate a developer;

a mounting portion including a receiving portion for receiving the developer discharged from said developer accommodating container and configured to mount said developer accommodating container;

a cover configured to open and close said mounting portion;

a motor configured to rotate said developer accommodating container;

a rotation detecting portion configured to detect rotation of said developer accommodating container mounted at said mounting portion;

a display portion configured to display information; and a controller configured to control said display portion so that information on the rotation of said developer accommodating container is displayed at said display portion in a case that when said cover is open, said rotation detecting portion detects a predetermined amount of the rotation of said developer accommodating container.

2. An image forming apparatus according to claim 1, wherein said mounting portion includes a feeding path configured to feed the developer supplied through said receiving portion to said developing device and includes a feeding member provided in said feeding path and configured to feed the developer, and wherein when said cover is open, an operation of said feeding member is stopped.

3. An image forming apparatus according to claim 1, wherein said developer accommodating container includes a rotatable accommodating portion configured to accommodate the developer, a discharging portion including a discharging opening for permitting discharge of the developer and mounted at said mounting portion substantially in a non-rotation state, and a feeding portion provided in said accommodating portion and configured to feed the developer in said accommodating portion toward said discharging portion.

4. An image forming apparatus according to claim 1, further comprising an opening and closing detecting portion configured to detect opening and closing of said cover.

5. An image forming apparatus according to claim 1, wherein in a case that when a number of rotations of said developer accommodating container detected by said rotation detecting portion does not reach a predetermined number, the information on the rotation of said developer accommodating container is not displayed at said display portion.

6. An image forming apparatus comprising:

a developing device configured to develop an electrostatic latent image formed on an image bearing member;

a rotatable developer accommodating container dismountably mounted in said image forming apparatus and configured to accommodate a developer;

a mounting portion including a receiving portion for receiving the developer discharged from said developer accommodating container and configured to mount said developer accommodating container;

a cover configured to open and close said mounting portion;

a motor configured to rotate said developer accommodating container;

a rotation detecting portion configured to detect rotation of said developer accommodating container mounted at said mounting portion; and a controller configured to provide warning about the rotation of said developer accommodating container at a display portion in a case that when said cover is open in a state in which said motor is stopped, said rotation detecting portion detects a predetermined amount of the rotation of said developer accommodating container.

7. An image forming apparatus according to claim 6, wherein said mounting portion includes a feeding path configured to feed the developer supplied through said receiving portion to said developing device and includes a feeding member provided in said feeding path and configured to feed the developer, and wherein when said cover is open, an operation of said feeding member is stopped.

8. An image forming apparatus according to claim 6, wherein said developer accommodating container includes a rotatable accommodating portion configured to accommodate the developer, a discharging portion including a discharging opening for permitting discharge of the developer and mounted at said mounting portion substantially in a non-rotation state, and a feeding portion provided in said accommodating portion and configured to feed the developer in said accommodating portion toward said discharging portion.

9. An image forming apparatus according to claim 6, further comprising an opening and closing detecting portion configured to detect opening and closing of said cover.

10. An image forming apparatus according to claim 6, wherein in a case that when a number of rotations of said developer accommodating container detected by said rotation detecting portion does not reach a predetermined number, said controller does not provide the warning about the rotation of said developer accommodating container.

11. An image forming apparatus comprising:

a developing device configured to develop an electrostatic latent image formed on an image bearing member;

a rotatable developer accommodating container dismountably mounted in said image forming apparatus and configured to accommodate a developer;

a mounting portion including a receiving portion for receiving the developer discharged from said developer accommodating container and configured to mount said developer accommodating container;

a cover configured to open and close said mounting portion;

a motor configured to rotate said developer accommodating container;

a rotation detecting portion configured to detect rotation of said developer accommodating container mounted at said mounting portion;

a display portion configured to display information; and a controller configured to control said display portion so that information on the rotation of said developer accommodating container is displayed at said display portion in a case that when said cover is open in a state in which said motor is stopped, said rotation detecting portion detects the rotation of said developer accommodating container.

12. An image forming apparatus according to claim 11, wherein said mounting portion includes a feeding path configured to feed the developer supplied through said receiving portion to said developing device and includes a feeding member provided in said feeding path and configured to feed the developer, and wherein when said cover is open, an operation of said feeding member is stopped.

13. An image forming apparatus according to claim 11, wherein said developer accommodating container includes a rotatable accommodating portion configured to accommodate the developer, a discharging portion including a discharging opening for permitting discharge of the developer and mounted at said mounting portion substantially in a non-rotation state, and a feeding portion provided in said accommodating portion and configured to feed the developer in said accommodating portion toward said discharging portion.

14. An image forming apparatus according to claim 11, further comprising an opening and closing detecting portion configured to detect opening and closing of said cover.

15. An image forming apparatus comprising:

a developing device configured to develop an electrostatic latent image formed on an image bearing member;

a rotatable developer accommodating container dismountably mounted in said image forming apparatus and configured to accommodate a developer;

a mounting portion including a receiving portion for receiving the developer discharged from said developer accommodating container and configured to mount said developer accommodating container;

a cover configured to open and close said mounting portion;

a motor configured to rotate said developer accommodating container;

a rotation detecting portion configured to detect rotation of said developer accommodating container mounted at said mounting portion; and a controller configured to provide warning about the rotation of said developer accommodating container at a display portion in a case that when said cover is open in a state in which said motor is stopped, said rotation detecting portion detects the rotation of said developer accommodating container.

16. An image forming apparatus according to claim 15, wherein said mounting portion includes a feeding path configured to feed the developer supplied through said receiving portion to said developing device and includes a feeding member provided in said feeding path and configured to feed the developer, and wherein when said cover is open, an operation of said feeding member is stopped.

17. An image forming apparatus according to claim 15, wherein said developer accommodating container includes a rotatable accommodating portion configured to accommodate the developer, a discharging portion including a discharging opening for permitting discharge of the developer and mounted at said mounting portion substantially in a non-rotation state, and a feeding portion provided in said accommodating portion and configured to feed the developer in said accommodating portion toward said discharging portion.

18. An image forming apparatus according to claim 15, further comprising an opening and closing detecting portion configured to detect opening and closing of said cover.

19. An image forming apparatus comprising:

a developing device configured to develop an electrostatic latent image formed on an image bearing member;

a rotatable developer accommodating container dismountably mounted in said image forming apparatus and configured to accommodate a developer;

a mounting portion including a receiving portion for receiving the developer discharged from said developer accommodating container and configured to mount said developer accommodating container;

a cover configured to open and close said mounting portion;

a motor configured to rotate said developer accommodating container;

a rotation detecting portion configured to detect rotation of said developer accommodating container mounted at said mounting portion;

a display portion configured to display information; and a controller configured to control said display portion so that information on the rotation of said developer accommodating container is displayed at said display portion in a case that when said cover is open in a state in which said motor is stopped, said developer accommodating container is rotated by a predetermined amount or more.

20. An image forming apparatus according to claim 19, wherein said mounting portion includes a feeding path configured to feed the developer supplied through said receiving portion to said developing device and includes a feeding member provided in said feeding path and configured to feed the developer, and wherein when said cover is open, an operation of said feeding member is stopped.

21. An image forming apparatus according to claim 19, wherein said developer accommodating container includes a rotatable accommodating portion configured to accommodate the developer, a discharging portion including a discharging opening for permitting discharge of the developer and mounted at said mounting portion substantially in a non-rotation state, and a feeding portion provided in said accommodating portion and configured to feed the developer in said accommodating portion toward said discharging portion.

22. An image forming apparatus according to claim 19, further comprising an opening and closing detecting portion configured to detect opening and closing of said cover.

23. An image forming apparatus according to claim 19, wherein in a case that when an amount of rotation of said developer accommodating container does not reach the predetermined amount of rotation of said developer accommodating container, the information on the rotation of said developer accommodating container is not displayed at said display portion.

24. An image forming apparatus according to claim 19, wherein the amount of rotation of said developer accommodating container is a number of rotations.

25. An image forming apparatus comprising:

a developing device configured to develop an electrostatic latent image formed on an image bearing member;

a rotatable developer accommodating container dismountably mounted in said image forming apparatus and configured to accommodate a developer;

a mounting portion including a receiving portion for receiving the developer discharged from said developer accommodating container and configured to mount said developer accommodating container;

a cover configured to open and close said mounting portion;

a motor configured to rotate the developer accommodating container;

a rotation detecting portion configured to detect rotation of said developer accommodating container mounted at said mounting portion; and a controller configured to provide warning about the rotation of said developer accommodating container at a display portion in a case that when said cover is open in a state in which said motor is stopped, said developer accommodating container is rotated by a predetermined amount or more.

26. An image forming apparatus according to claim 25, wherein said mounting portion includes a feeding path configured to feed the developer supplied through said receiving portion to said developing device and includes a feeding member provided in said feeding path and configured to feed the developer, and wherein when said cover is open, an operation of said feeding member is stopped.

27. An image forming apparatus according to claim 25, wherein said developer accommodating container includes a rotatable accommodating portion configured to accommodate the developer, a discharging portion including a discharging opening for permitting discharge of the developer and mounted at said mounting portion substantially in a non-rotation state, and a feeding portion provided in said accommodating portion and configured to feed the developer in said accommodating portion toward said discharging portion.

28. An image forming apparatus according to claim 25, further comprising an opening and closing detecting portion configured to detect opening and closing of said cover.

29. An image forming apparatus according to claim 25, wherein in a case that when an amount of rotation of said developer accommodating container does not reach the predetermined amount of rotation of said developer accommodating container, said controller does not provide the warning about the rotation of said developer accommodating container.

30. An image forming apparatus according to claim 25, wherein the amount of rotation of said developer accommodating container is a number of rotations.

* * * * *